US005737927A

United States Patent [19]

Takahashi et al.

[11] Patent Number: 5,737,927

[45] Date of Patent: Apr. 14, 1998

[54] CRYOGENIC COOLING APPARATUS AND CRYOGENIC COOLING METHOD FOR COOLING OBJECT TO VERY LOW TEMPERATURES

[75] Inventors: Masahiko Takahashi; Yasumi Ohtani, both of Yokohama; Rohana Chandratilleke, Tokyo; Hideo Hatakeyama, Yokohama; Hideki Nakagome, Tokyo; Toru Kuriyama, Kawasaki, all of Japan

[73] Assignee: Kabushiki Kaisha Toshiba, Kawasaki, Japan

[21] Appl. No.: 816,737

[22] Filed: Mar. 14, 1997

[30] Foreign Application Priority Data

Mar. 18, 1996 [JP] Japan ..... 8-061458

[51] Int. Cl.[6] ..... F25B 19/00

[52] U.S. Cl. ..... 62/51.1; 62/383

[58] Field of Search ..... 62/51.1, 383

[56] References Cited

U.S. PATENT DOCUMENTS

| | | | |
|---|---|---|---|
| 3,430,455 | 3/1969 | Stuart et al. | 62/383 |
| 3,717,201 | 2/1973 | Hosmer et al. | 62/383 |
| 4,495,782 | 1/1985 | Salour et al. | 62/51.1 |
| 4,777,807 | 10/1988 | White | 62/51.1 |
| 4,790,147 | 12/1988 | Kuriyama et al. | 62/51.1 |
| 4,924,198 | 5/1990 | Laskaris . | |
| 5,379,601 | 1/1995 | Gillett | 62/51.1 |

OTHER PUBLICATIONS

Cryogenics, vol. 34, pp. 643–646, 1994, Toru Kuriyama, et al., "Cryocooler Directly Cooled 6 T NbTi Superconducting Magnet System with 180 mm Room Temperature Bore".

Advances in Cryogenic Engineering, vol. 41, pp. 319–324, Jul. 1995, K. Watanabe, et al., "Cryogen–Free Split–Pair Superconducting Magnet with A ϕ 50 mm × 10 mm Room Temperature Gap".

*Primary Examiner*—Ronald C. Capossela

*Attorney, Agent, or Firm*—Oblon, Spivak, McClelland, Maier & Neustadt, P.C.

[57] ABSTRACT

A cryogenic cooling apparatus is provided, wherein the degree of freedom of installation and use is increased without deteriorating the reliability or stability and the range of uses of the apparatus is also increased. A coil unit and a refrigeration unit are positioned such that a second heat conductive member disposed on an extendible wall of a vacuum container and a fourth heat conductive member disposed on an extendible wall of another vacuum container face each other coaxially. In this state, the coil unit and refrigeration unit are relatively moved to approach each other, and thus the second heat conductive member and fourth heat conductive member come in contact. If the coil unit and refrigeration unit are further moved, the extendible wall extends and consequently the second heat conductive member comes in contact with a first heat conductive member. In addition, the extendible wall contracts and consequently the fourth heat conductive member comes in contact with a third heat conductive member. Thus, a superconducting coil is thermally connected to the refrigeration unit so that the superconducting coil is cooled.

33 Claims, 10 Drawing Sheets

CRYOGENIC COOLING APPARATUS AND CRYOGENIC COOLING METHOD FOR COOLING OBJECT TO VERY LOW TEMPERATURES

BACKGROUND OF THE INVENTION

The present invention relates to a cryogenic cooling apparatus for cooling an object such as a superconducting coil.

As is well known, recent development in refrigeration technology is remarkable. A small-sized refrigerator capable of efficiently attaining a temperature level of liquid helium has been developed, in particular, by virtue of the discovery of a cold accumulation element exhibiting high specific heat characteristics at very low temperatures.

In fact, this type of refrigerator, in general, adopts a cold accumulation system represented by a Gifford-MacMahon refrigeration cycle or a Stirling refrigeration cycle.

With the development of the refrigeration technology, a superconducting magnet apparatus of a refrigerator direct-cooling type has recently been developed wherein a superconducting coil housed in heat-insulating container is directly cooled by a cryogenic refrigerator.

In the superconducting magnet apparatus of the refrigerator direct-cooling type, unlike a conventional dip-cooling type apparatus wherein a superconducting coil is dipped and cooled in liquid helium, there is no need to use a coolant. Thus, the handling of the apparatus is very easy and the system can be simplified and the operating cost reduced.

However, the superconducting magnet apparatus of the refrigerator direct-cooling type has the following problems.

In the superconducting magnet apparatus of the refrigerator direct-cooling type, in general, a superconducting coil and a thermal shield are housed in a vacuum container serving as a heat-insulating container, and a plurality of stages of cold accumulating refrigerators are disposed so that cooling stages are situated within the vacuum container.

The lowest-temperature cooling stage of the cold accumulating refrigerator is thermally connected to the superconducting coil by a heat conductive member, and the cooling stage of a temperature different from the temperature of the lowest-temperature cooling stage is thermally connected to the thermal shield by another heat conductive member.

Since the superconducting magnet apparatus of the above-described refrigerator direct-cooling type has the structure wherein the cold accumulating refrigerator is directly attached to the vacuum container containing the superconducting coil, the following problems are posed:

(1) It is difficult to reduce the size of a so-called coil unit by reducing the size of the vacuum container because of the presence of the cold accumulating refrigerator. Thus, the coil unit is inevitably large, and the degree of freedom of installation and use is low.

(2) In the cold accumulating refrigerator, as represented by the Gifford-MacMahon refrigeration cycle, a displacer containing a cold accumulator having at least one stage must be driven. Thus, occurrence of mechanical vibration is inevitable. Vibration of the cold accumulating refrigerator is transmitted to the superconducting coil, and due to the vibration of the superconducting coil, the uniformity of magnetic field produced by the coil is degraded.

(3) An example of the cold accumulation element exhibiting high specific heat characteristics at very low temperatures is a cold accumulation element making use of abnormal magnetic specific heat caused by magnetic phase transition. This cold accumulation element is a magnetic element.

If this magnetic cold accumulation element is built in the cold accumulator of the cold accumulating refrigerator situated near the superconducting coil, the symmetry of magnetic field produced by the superconducting coil is greatly disturbed. In addition, if the displacer containing the cold accumulator having the magnetic cold accumulation element is driven, the displacer will be inclined by an electromagnetic force caused between the magnetic field produced by the superconducting coil and the magnetic cold accumulation material. This will accelerate wear of the sealing member, etc., resulting a decrease in refrigeration performance of the refrigerator in a short time.

(4) In the superconducting magnet apparatus of the refrigerator direct-cooling type, as compared to the dip-cooling type apparatus, the time needed to cool the superconducting coil from normal temperature down to a predetermined temperature is longer. In order to decrease this time, a refrigerator with a large capacity must be built in. As a result, the size of the magnet apparatus inevitably increases, and the feature of the refrigerator direct-cooling type apparatus cannot be exhibited.

As has been described above, the superconducting magnet apparatus of refrigerator direct-cooling type has problems as regards the degrees of freedom in installation and use, stability and reliability.

BRIEF SUMMARY OF THE INVENTION

The present invention has been made in consideration of the above-described circumstances, and an object of the present invention is to provide a cryogenic cooling apparatus wherein the degree of freedom of installation and use of the cooling apparatus can be increased without deteriorating the reliability and stability, and the range of uses can be greatly increased.

Another object of the present invention is to provide a cryogenic cooling method using such a cryogenic cooling apparatus.

In order to achieve the above objects, the cryogenic cooling apparatus of the present invention is based on the following two basic concepts.

A cooling apparatus according to a first concept of the invention comprises a coil storing vacuum container; a superconducting coil stored in the coil storing vacuum container; a first heat conductive member thermally connected to the superconducting coil within the coil storing vacuum container; a first extendible wall formed to constitute a part of the wall of the coil storing vacuum container, situated normally at a location away from the first heat conductive member, and displaced toward the first heat conductive member when pushed toward the first heat conductive member; a second heat conductive member disposed on the first extendible wall and put in contact with the first heat conductive member when the first extendible wall has moved toward the first heat conductive member by a predetermined distance, thereby constituting a heat conduction path reaching the superconducting coil; a cooling source vacuum container; a cooling source having a cooling stage situated within the cooling source vacuum container; a third heat conductive member thermally connected to the cooling stage within the cooling source vacuum container; a second extendible wall formed to constitute a part of the wall of the cooling source vacuum container, situated normally at a location away from the third heat conductive member, and displaced toward the third heat conductive member when pushed toward the third heat conductive member; and a fourth heat conductive member disposed on the second extendible wall. When the superconducting coil is cooled down to a critical temperature or below, the coil storing vacuum container and cooling source vacuum container are relatively moved to approach each other. Thereby, the first extendible wall and second extendible wall are displaced to constitute a mechanical-contact-type heat conduction path comprising the third heat conductive member, fourth heat conductive member, second heat conductive member and first heat conductive member. The superconducting coil is cooled via this heat conduction path.

In this cryogenic cooling apparatus, the coil storing vacuum container, which stores the superconducting coil, and the cooling source vacuum container are constituted completely separately from the beginning. Thus, when the superconducting coil is cooled down to the critical temperature or below, the vacuum within the coil storing vacuum container as well as the cooling source vacuum container is not lost. The extendible walls, which constitute parts of the heat conduction path, are provided as portions of the walls of both vacuum container. The extendible walls are forcibly moved to constitute the mechanical-contact-type heat conduction path extending from the cooling stage of the cooling source to the superconducting coil.

After the superconducting coil has been cooled to the critical temperature or below, the coil storing vacuum container is separated from the cooling source vacuum container.

In the above cryogenic cooling apparatus, a liquid coolant source such as a liquid helium bath can be used as the cooling source. Accordingly, the time needed to cool the superconducting coil to a predetermined temperature can be shortened.

Needless to say, depending on conditions, the superconducting coil can be cooled by one of selectable refrigerators having different cooling performances. A plurality of superconducting coils housed within coil storing vacuum containers can be successively cooled by a single cooling source in a time-sequential manner.

It is also possible to cool the superconducting coil in a place different from an installation site, and then carry the superconducting coil to the installation site. Since the cooling source can selectively be connected to and disconnected from the cooling source, the coil unit can be designed independently of the cooling source and the size of the coil unit can be reduced.

In the above cryogenic cooling apparatus, the cooling source is separated after the superconducting coil has been cooled. Thus, the temperature of the superconducting coil increases gradually. The rate of increase in temperature is determined by the thermal capacity of the superconducting coil. Accordingly, in order to keep the temperature of the superconducting coil below the critical temperature for a long time, it is preferable to have the superconducting coil put in thermal contact with a cold accumulation layer having a high specific heat at or less than the critical temperature of the superconducting coil.

In order to make the superconducting coil continuously generate a stable magnetic field, it is necessary to provide power leads for supplying power and a permanent current switch as original structural parts. The power leads and control wires for the permanent current switch constitute heat entrance paths from the outside.

To solve this problem, it is advantageous to provide conductor paths constituting the power leads for the superconducting coil and the control wires of the permanent current switch, which are electrically connected to each other when the mechanical-contact-type heat conduction path extending from the cooling stage of the cooling source to the superconducting coil is constituted. In this case, after the superconducting coil has been cooled and set in the permanent current mode, the cooling source is separated. Thereby, the power leads and control wires can be completely separated from the superconducting coil. Therefore, it is possible to prevent heat from entering via the power leads and control wires.

In this cryogenic cooling apparatus, the degree of freedom of installation and use is high and the cooling source can be completely separated during operation. Accordingly, the size of the coil unit can be reduced, the stability of the generated magnetic field enhanced, and the range of uses increased.

A cooling apparatus according to a second concept comprises a coil storing vacuum container; a superconducting coil stored within the coil storing vacuum container; a refrigerator vacuum container; a refrigerator having a cooling stage situated within the refrigerator vacuum container; a flexible pipe for communication between the coil storing vacuum container and the refrigerator vacuum container; and a heat conductive member for thermally connecting the cooling stage of the refrigerator and the superconducting coil through the pipe, the heat conductive member including at least a flexible portion.

In this cryogenic cooling apparatus, the coil storing vacuum container, which stores the superconducting coil, and the refrigerator vacuum container are separately arranged. Both containers are made to communicate with each other by means of the flexible pipe. The heat conductive member including at least a flexible portion thermally connects the cooling stage of the refrigerator and the superconducting coil through the pipe.

With this structure, the distance between the vacuum container storing the superconducting coil and the refrigerator vacuum container can be freely set. Thus, the size of the unit storing the superconducting coil can be reduced independently of the presence of the refrigerator.

Even if a cold accumulating refrigerator, wherein a magnetic cold accumulation element is built in a cold accumulator, is used as the refrigerator, a magnetic interference between the magnetic field generated by the superconducting coil and the magnetic cold accumulation element can be prevented. Thus, the symmetry of magnetic field generated by the superconducting coil is not lost.

Since the displacer is prevented from being inclined, the refrigeration performance of the refrigerator can be stably maintained over a long time period. Since both containers are connected by means of the flexible element, the vibration of the refrigerator is prevented from being transmitted to the superconducting coil and the uniformity of the magnetic field can be maintained.

From the standpoint of heat-transport efficiency, it is desirable that the heat conductive member comprises, at least as a portion-thereof, a loop-type thin heat pipe or a dream pipe.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE INVENTION

Embodiments of the present invention will now be described with reference to the accompanying drawings.

<First Embodiment>

Figure 1:
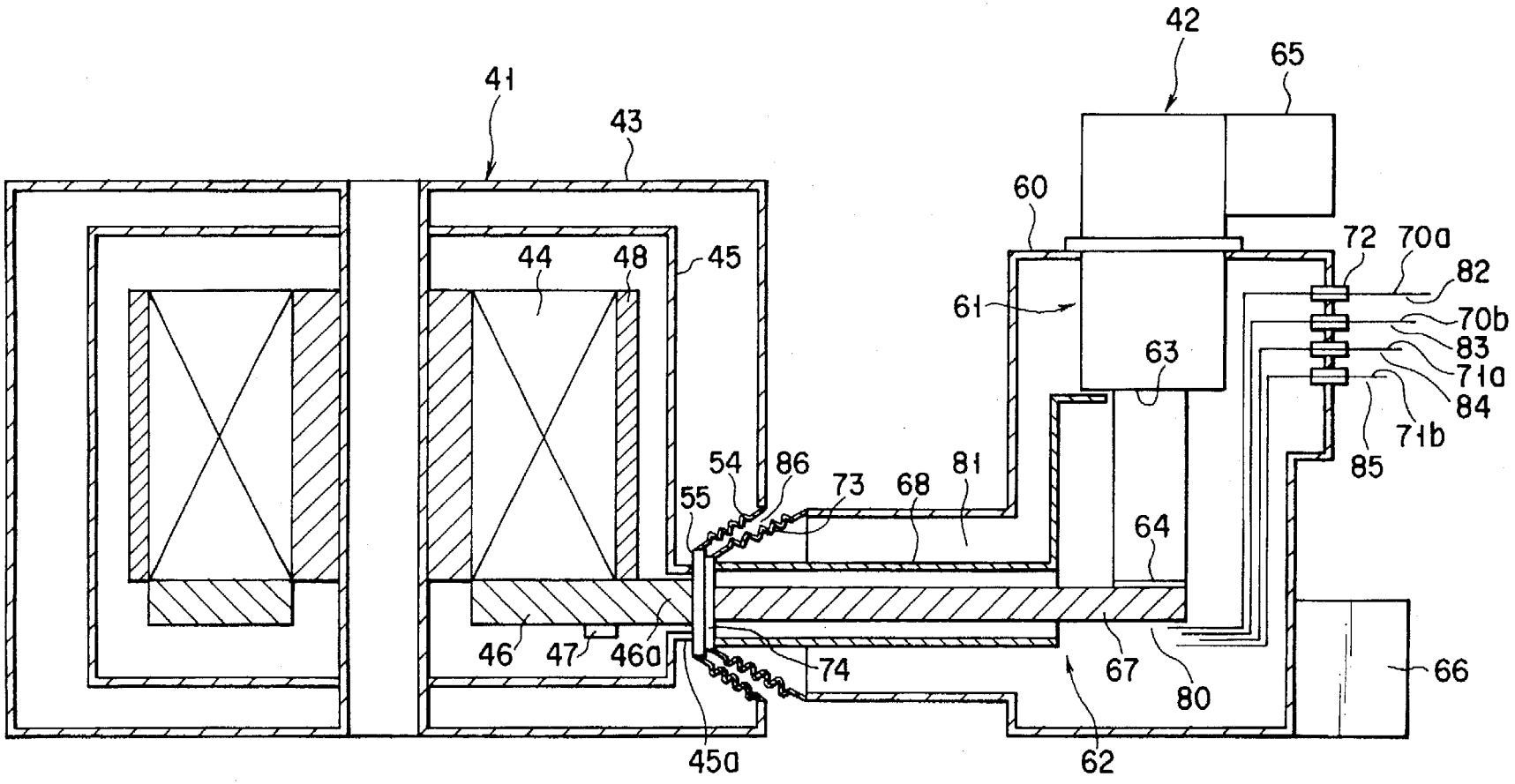
FIG. 1 is a cross-sectional view of a part of a cryogenic cooling apparatus for a superconducting magnet, according to a first embodiment of the present invention.

FIG. 1 is a cross-sectional view of a part of a cryogenic cooling apparatus for a superconducting magnet, according to a first embodiment of the present invention.

The cryogenic cooling apparatus generally comprises a coil unit 41 and a refrigeration unit 42 separated from the coil unit 41.

Figure 2:
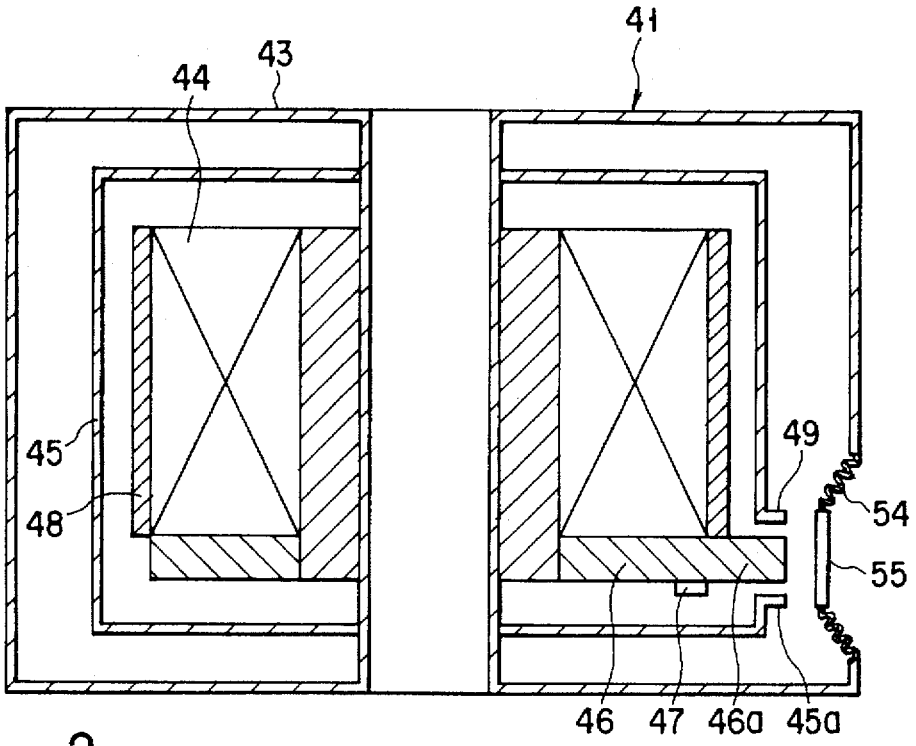
FIG. 2 is a cross-sectional view of a part of a coil unit of the cryogenic cooling apparatus according to the first embodiment.

The coil unit 41, as shown in FIGS. 1 and 2, comprises an annular vacuum container 43 functioning as a heat insulating container formed of a nonmagnetic material such as stainless steel, a superconducting coil 44 (cooling object) housed within the vacuum container 43, and a thermal shield 45 disposed between the superconducting coil 44 and vacuum container 43 so as to surround the superconducting coil 44.

The superconducting coil 44 is formed of an Nb—Ti alloy wire or an $Nb_3Sn$ wire and is supported by heat insulating support means (not shown). A heat conductive member 46 formed of a material with good heat conductivity such as copper, aluminum or aluminum nitride is thermally connected to a lower end face (in FIGS. 1 and 2) of the superconducting coil 44.

End portions of the superconducting coil 44 are connected to both ends of a permanent current switch 47 provided on the heat conductive member 46 serving as a support. A cold accumulation element having a high specific heat at temperatures lower than a critical temperature of the superconducting coil 44, for example, a cold accumulation layer 48 mixed with particles of $Er_3Ni$, is provided around the superconductive coil 44 in the state in which the cold accumulation element is put in thermal contact with the superconducting coil 44.

A part 46*a* of the heat conductive member 46 projects toward a side wall of the vacuum chamber 43, and a part 45*a* of the thermal shield 45 projects coaxially with the part 46*a*.

Figure 3:
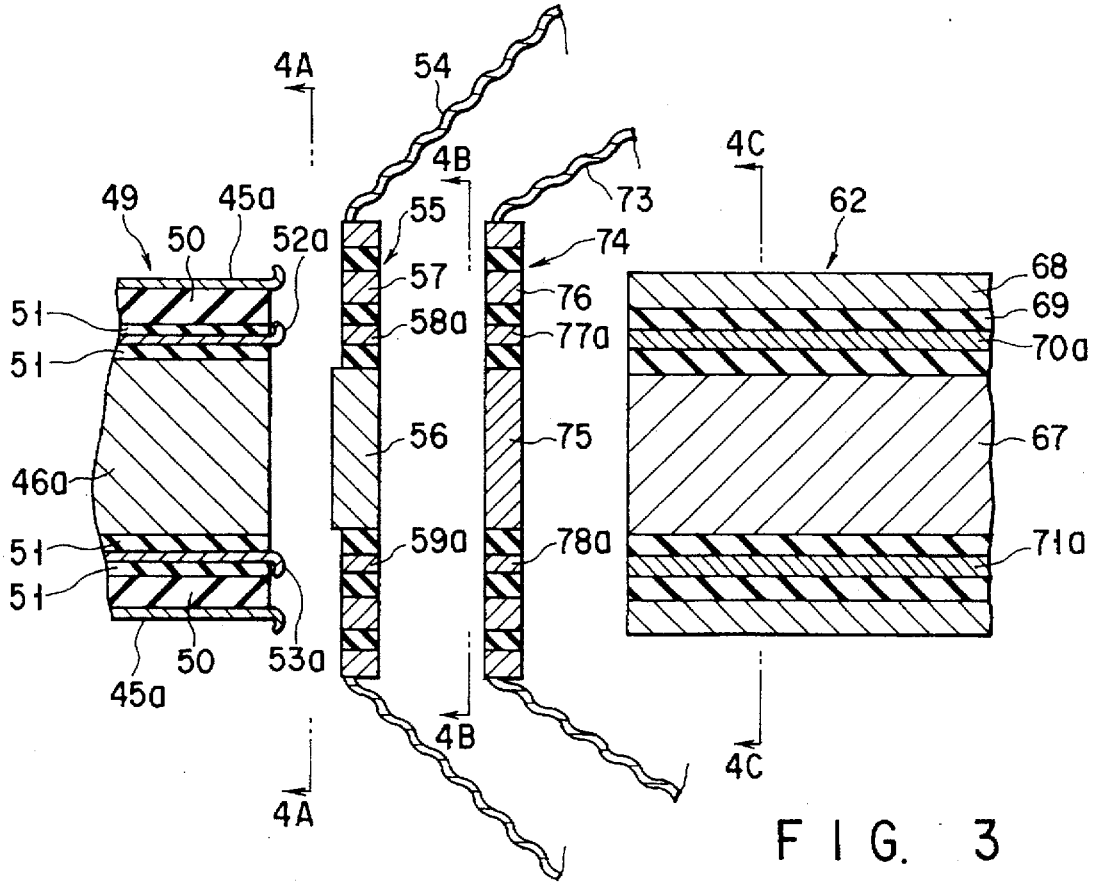
FIG. 3 is an enlarged view of a coupling portion between the coil unit and a refrigeration unit of the cryogenic cooling apparatus according to the first embodiment.

The parts 46*a* and 45*a* constitute a first heat conductive member 49. The part 46*a* serves as a first heat conductive portion and the part 45*a* serves as a second heat conductive portion. A heat insulating member 50 and an electric insulating member (fiber reinforced plastic) 51 are provided between the parts 46*a* and 45*a*, as shown in FIG. 3.

Power lead portions 52*a* and 52*b* connected to both ends of the permanent current switch 47 and control wire portions 53*a* and 53*b* for controlling the permanent current switch 47 are buried in the electric insulating member 51.

Figure 4A:
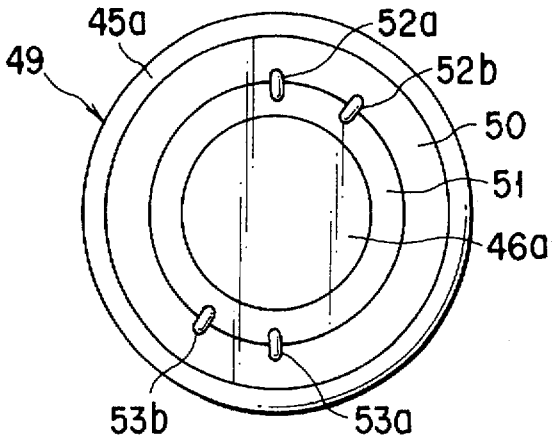
FIG. 4A is a view taken along line 4A—4A in FIG. 3.

The end portions of the power lead portions 52*a* and 52*b* and the end portions of the control wire portions 53*a* and 53*b* are exposed to face the side wall of the vacuum container 43, as shown in FIG. 4A.

A bellows-type extendible wall 54 is disposed on the side wall of the vacuum container 43 in a position facing the first heat conductive member 49. The extendible wall 54 is normally situated in a position away from the first heat conductive member 49. Although the extendible wall 54 is not moved due to a degree of vacuum within the vacuum container 43, it is displaced toward the first heat conductive member 49 when an external force of a predetermined level or more is applied. A second heat conductive member 55 is provided on the extendible wall 54 in a position facing the first heat conductive member 49.

The second heat conductive member 55, as shown in FIG. 3, comprises a first heat conductive portion 56 formed of a material with good heat conductivity, which is situated to face the end face of the part 46*a* of the first heat conductive member 49, and a second heat conductive portion 57 formed of a material with good heat conductivity, which is situated to face the part 45*a*. The first heat conductive portion 56 and second heat conductive portion 57 are electrically insulated from each other and from the extendible wall 54 by means of electrical insulators.

Figure 4B:
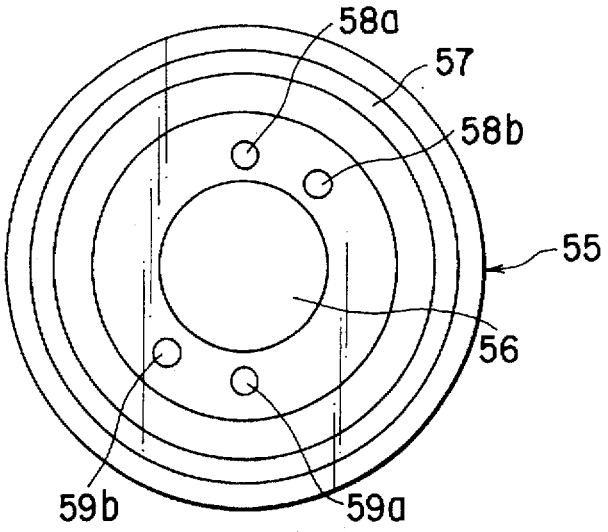
FIG. 4B is a view taken along line 4B—4B in FIG.3.

Power lead portions 58*a* and 58*b* and control wire portions 59*a* and 59*b* are provided in an electrically insulated state between the first heat conductive portion 56 and the second heat conductive portion 57, as shown in FIG. 4B, too, such that the power lead portions 58*a* and 58*b* and control wire portions 59*a* and 59*b* face the end portions of the power lead portions 52*a* and 52*b* and the end portions of the control wire portions 53*a* and 53*b* provided in the first heat conductive member 49.

On the other hand, the refrigeration unit 42 comprises a vacuum container 60, a cold accumulating refrigerator (cooling source) 61 situated to extend inside and outside the vacuum container 60 such that cooling stages are located within the vacuum container 60, and a third heat conductive member 62 thermally connected to the cooling stage of the cold accumulating refrigerator 61.

In this embodiment, the cold accumulating refrigerator 61 is constituted by a two-stage expansion type Gifford-MacMahon refrigerator. In the cold accumulating refrigerator 61, copper mesh, etc. is used as a cold accumulation element in a first-stage cold accumulator, and a magnetic cold accumulation element such as $Er_3Ni$, which makes use of abnormal magnetic specific heat due to magnetic phase transition, is used as a cold accumulation element in a second-stage cold accumulator.

By the use of these cold accumulating elements, cold of about 50 K is generated by a first-stage cooling stage 63 and cold of about 4 K is generated by a second-stage cooling stage 64. In FIG. 1, reference numeral 65 denotes a motor for reciprocally moving the displacer containing the cold accumulators connected serially in two stages, and numeral 66 denotes a compressor for compressing and sucking a coolant gas.

The third heat conductive member 62, as shown in FIG. 3, too, comprises a first heat conductive portion 67 formed of a material with good heat conductivity and having one end thermally connected to the second cooling stage 64, and a second heat conductive portion 68 formed of a material with good heat conductivity and having one end thermally connected to the first cooling stage 63 and the other end situated coaxially with the first heat conductive portion 67.

Figure 4C:
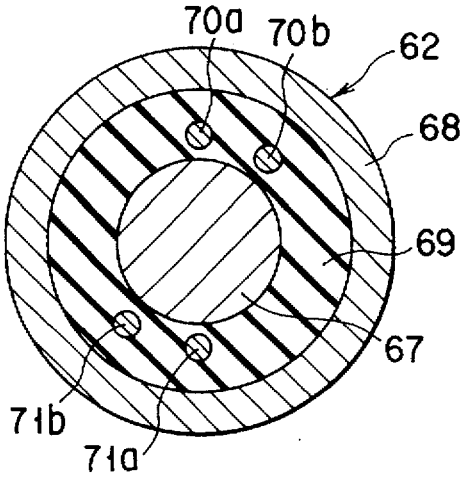
FIG. 4C is a cross-sectional view taken along line 4C—4C in FIG. 3.

The first heat conductive portion 67 and second heat conductive portion 68 are insulated from each other by means of an electrical insulator (thermal insulator). As is shown in FIG. 4C, power lead portions 70*a* and 70*b* and control wire portions 71*a* and 71*b* are provided in an electrically insulated state between the first heat conductive portion 67 and second heat conductive portion 68.

As is shown in FIGS. 1 and 3, end faces of the third heat conductive member 62 having the above structure are opposed to the side wall of the vacuum container 60. An end portion of each of the power lead portions 70*a* and 70*b* and control wire portions 71*a* and 71*b* is led to the outside via an associated bushing 72 hermetically penetrating the wall of the vacuum container 60, as shown in FIG. 1.

A bellows-type extendible wall 73 is disposed on the side wall of the vacuum container 60 in a position facing the third heat conductive member 62. The extendible wall 73 is normally situated in a position away from the third heat conductive member 62. Although the extendible wall 73 is not moved due to a degree of vacuum within the vacuum container 60, it is displaced toward the third heat conductive member 62 when an external force of a predetermined level or more is applied. A fourth heat conductive member 74 is provided on the extendible wall 73 in a position facing the third heat conductive member 62.

The fourth heat conductive member 74 has substantially the same diameter and structure as the second heat conductive member 55. Specifically, the fourth heat conductive member 74, as shown in FIG. 3, comprises a first heat conductive portion 75 formed of a material with good heat conductivity, which is situated to face the end face of the first heat conductive portion 67 of third heat conductive member 62, and a second heat conductive portion 76 formed of a material with good heat conductivity, which is situated to face the second heat conductive portion 68.

The first heat conductive portion 75 and second heat conductive portion 76 are electrically insulated from each other and from the extendible wall 73 by means of electrical insulators. Power lead portions 77*a* and 77*b* (only 77*a* shown) and control wire portions 78*a* and 78*b* (only 78*a* shown) are provided in an electrically insulated state between the first heat conductive portion 75 and the second heat conductive portion 76 such that the power lead portions 77*a* and 77*b* and control wire portions 78*a* and 78*b* face the end portions of the power lead portions 70*a* and 70*b* and the end portions of the control wire portions 71*a* and 71*b* provided in the third heat conductive member 62.

A method of thermally connecting the refrigeration unit and the coil unit will now be described.

The coil unit 41 and refrigeration unit 42 are positioned so that the second heat conductive member 55 provided on the extendible wall 54 of vacuum container 43 may coaxially face the fourth heat conductive member 74 provided on the extendible wall 73 of vacuum container 60. In this state, the coil unit 41 and refrigeration unit 42 are relatively moved to approach each other. Then, the second heat conductive member 55 comes into contact with the fourth heat conductive member 74.

If the coil unit 41 and refrigeration unit 42 are further moved to approach each other, the extendible wall 54 extends and thus the second heat conductive member 55 comes in contact with the first heat conductive member 49, as shown in FIG. 1. In addition, the extendible wall 73 contracts and thus the fourth heat conductive member 74 comes in contact with the third heat conductive member 62.

In this state, a mechanical contact type first heat conduction path 80 is constituted by the first heat conductive portions 67, 75, 56 and 46*a* of the third heat conductive member 62, fourth heat conductive member 74, second heat conductive member 55 and first heat conductive member 49, and a mechanical contact type second heat conduction path 81 is constituted by the second heat conductive portions 68, 76, 57 and 45*a*. In addition, power leads 82 and 83 are constituted by mutual contact among the power lead portions 70*a*, 77*a*, 58*a* and 52*a* and among the power lead portions 70*b*, 77*b*, 58*b* and 52*b*.

The mechanical contact type heat conduction path constitutes thermal switch wherein heat is conducted by putting heat conduction members in contact with each other and heat is insulated by separating them.

The dimensions of the respective parts and the positional relationship among them are determined so that control wires 84 and 85 may be constituted by mutual contact among the control wire portions 71*a*, 78*a*, 59*a* and 53*a* and among the control wire portions 71*b*, 78*b*, 59*b* and 53*b*.

In the above structure, the superconducting coil 44 is cooled down to a critical temperature or below and subsequently shifted to a permanent current mode, in the following manner.

First, the operation of the cold accumulating refrigerator 61 of the refrigeration unit 42 is started. Then, as shown in FIG. 1, the coil unit 41 and refrigeration unit 42 are mechanically coupled, thereby constituting the aforementioned first and second heat conduction paths 80 and 81.

At this time, the entrance of a gap 86 between the extendible walls 54 and 73 may be sealed and the gap 86 may be evacuated.

Since the first and second heat conduction paths 80 and 81 have been constituted, the heat of the superconducting coil 44 is absorbed by the second cooling stage 64 of cold accumulating refrigerator 61 via the first heat conduction path 80 and the heat of the thermal shield 45 is absorbed by the first cooling stage 63 via the second heat conduction path 81.

If a predetermined time period has passed, the superconducting coil 44 is cooled to about 4 K which is below a critical temperature, and the thermal shield 45 is cooled to about 50 K.

In this state, an electric current of a predetermined level is supplied over the control wires 84 and 85, and the permanent current switch 47 is turned off. Then, a current is supplied to the superconducting coil 44 via the power leads 82 and 83, while the current is increased at a predetermined rate.

When the magnitude of the current supplied to the superconducting coil 44 has reached a target value, the current supplied over the control wires 84 and 85 is reduced to zero and the permanent current switch 47 is turned on.

Then, the current supplied over the power leads 82 and 83 is decreased at a predetermined rate and reduced to zero. Thereby, a permanent current continues to flow in the superconducting coil 44.

Subsequently, the coil unit 41 is mechanically decoupled from the refrigeration unit 42. As a result, the extendible wall 54 of the coil unit 41 contracts, and the second heat conductive member 55 is separated from the first heat conductive member 49, as shown in FIGS. 2 and 3.

On the other hand, the extendible wall 73 of the refrigeration unit 42 extends and, as shown in FIG. 3, the fourth heat conductive member 74 is separated from the third heat conductive member 62.

As described above, the heat conduction members are thermally separated, and the superconducting coil is thermally insulated.

Figure 5:
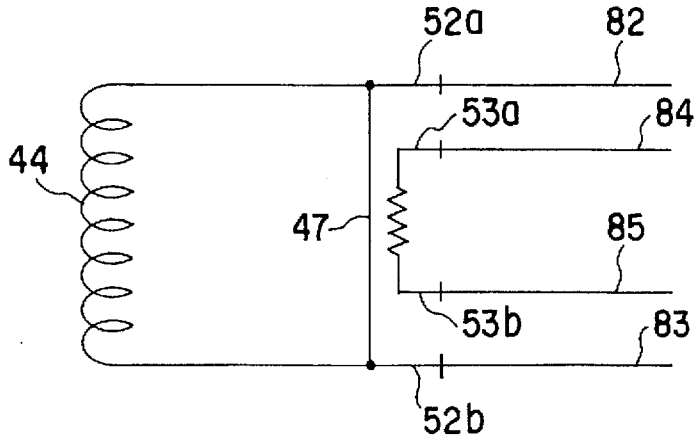
FIG. 5 is a circuit diagram in a mode in which the coil unit and the refrigeration unit are coupled.
Figure 6:
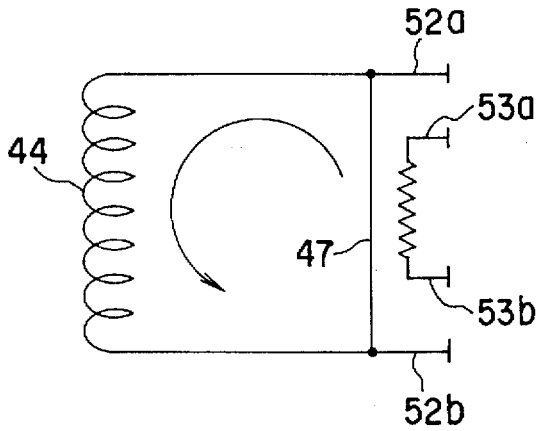
FIG. 6 is a circuit diagram in a mode in which the coil unit and the refrigeration unit are separated.

FIG. 5 shows the connection among the superconducting coil 44, permanent current switch 47, power leads 82 and 83 and control wires 84 and 85 in the state in which the coil unit 41 is mechanically coupled to the refrigeration unit 42. FIG. 6 shows the connection in the state in which the coil unit 41 is mechanically decoupled from the refrigeration unit 42. In the state shown in FIG. 6, the permanent current continues to flow in the superconducting coil 44.

Since the cooling source for cooling the superconducting coil 44 is completely separated, the temperature of the superconducting coil 44 tends to increase gradually. In this embodiment, however, the cold accumulation layer 48 having a high specific heat at temperatures equal to or less than the critical temperature of the superconducting coil 44 is situated in thermal contact with the superconducting coil 44, the superconducting coil 44 can be maintained at temperatures equal to or less than the critical temperature over a long time period.

As has been described above, the coil unit 14 and refrigeration unit 42 are constructed as completely separated units, and only when the superconducting coil 44 needs to be cooled, both are coupled (thermal connection) while the vacuum state is maintained.

And then, the coil unit 14 and refrigeration unit 42 are separated (thermally separated) if the superconducting coil 44 is insulated.

Accordingly, the coil unit 41 can be designed independently of the refrigeration unit 42, and the size of the coil unit 41 can be reduced. With the above structure, a plurality of coil units 41 each containing the superconducting coil 44 can be successively cooled by a single refrigeration unit 42 in a time-sequential manner. Besides, the superconducting coil 44 can be cooled or supplied with power by one of refrigeration units 42 having different refrigeration performances which can be selected in accordance with modes, e.g. pre-cooling mode, power supply mode, etc.

It is also possible to cool the coil unit 41 and set it in a permanent current mode in a place different from an installation site, and then carry the coil unit 41 to the installation site. The range of uses of this cooling apparatus is very wide. Since the refrigeration unit 42 can be separated from the coil unit 41 in the normal operation mode, the coil unit 41 can be used in the condition free from vibration or noise.

In the above-described embodiment, the cold accumulating refrigerator 61 is used in the refrigeration unit 42. However, a liquid coolant such as liquid helium may be used as a refrigerant source. In this case, the superconducting coil 44 can be cooled to the critical temperature or below in a shorter time period.

In the above-described embodiment, the cold accumulation layer 48 mixed with the particles of magnetic cold accumulation element is provided on the superconducting coil 44. However, a container filled with at least one selected from the group consisting of helium, hydrogen, neon, nitrogen and argon may be provided on the superconducting coil 44 as a cold accumulating layer.

In the above embodiment, conductors are provided to form a pair of power leads and a pair of control wires. However, the first to fourth heat conductive members may be also used as one of the power leads and one of the control wires.

In this embodiment, the first heat conductive member 49 and second heat conductive member 55 are mechanically coupled to constitute the heat transmission paths. The method of contacting the first and second heat conductive members 49 and 55 with each other is not limited to this.

Specifically, it should suffice if the first heat conductive member 49 and second heat conductive member 55 can be thermally separated. For example, a thermal switch may be used. In this case, a gas is sealed between the first and second heat conductive members 49 and 55, thereby effecting heat conduction.

When the gas is sealed between the first and second heat conductive members 49 and 55, the thermal switch is turned on and the heat conduction path is constituted between the superconducting coil and refrigerator. On the other hand, if the gas is exhausted and a vacuum is created, the thermal switch is turned off and the heat conduction path between the superconducting coil and refrigerator is cut off.

<Second Embodiment>

A cryogenic cooling apparatus according to a second embodiment of the present invention will now be described with reference to FIGS. 7 and 8.

The second embodiment differs from the first embodiment with respect to the construction of the heat conductive path. The other parts of the second embodiment are common to those of the first embodiment shown in FIG. 1. The common parts are denoted by like reference numerals, and a description thereof is omitted.

Figure 7:
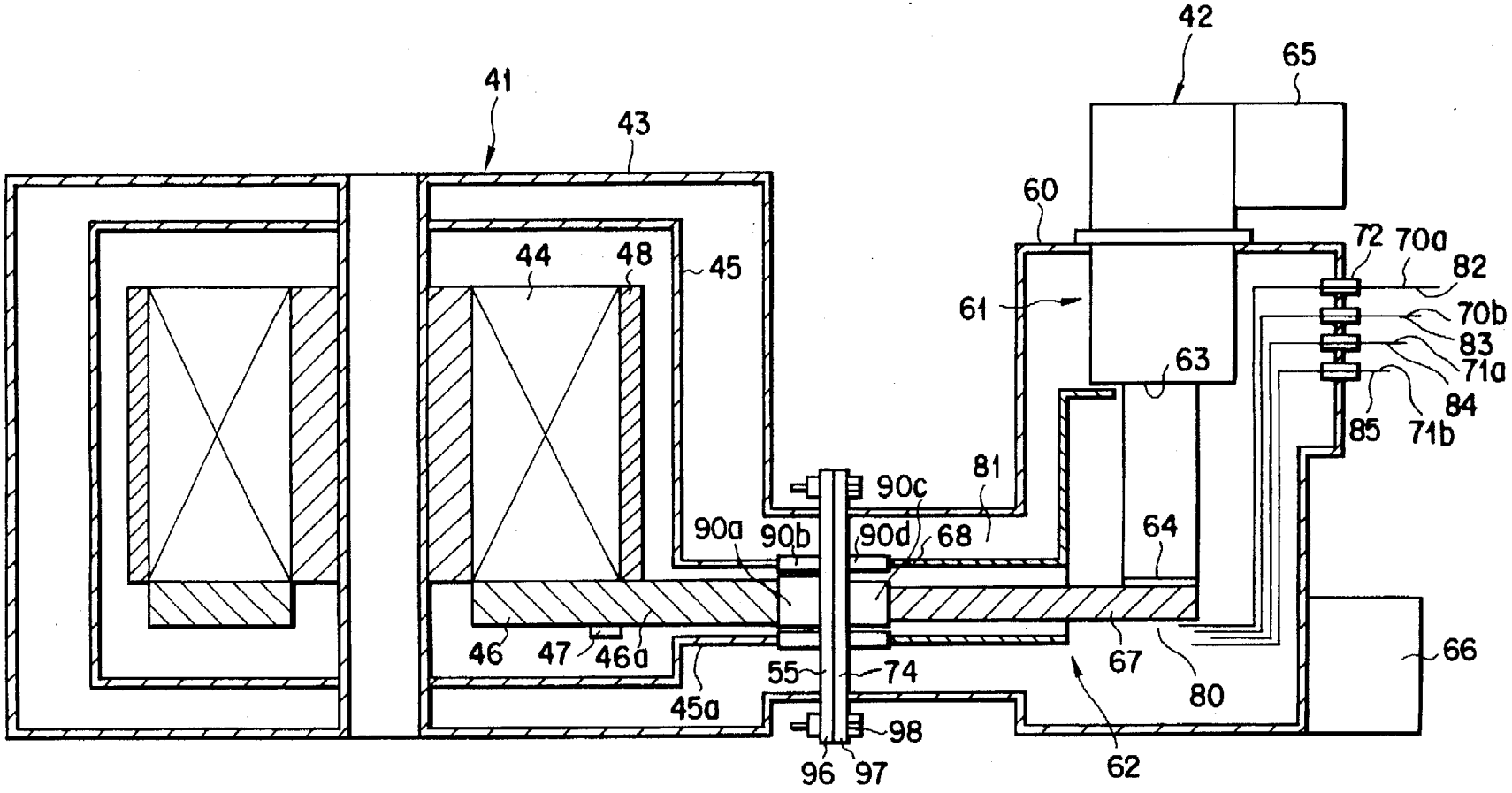
FIG. 7 is a cross-sectional view of a part of a cryogenic cooling apparatus for a superconducting magnet, according to a second embodiment of the present invention.
Figure 8:
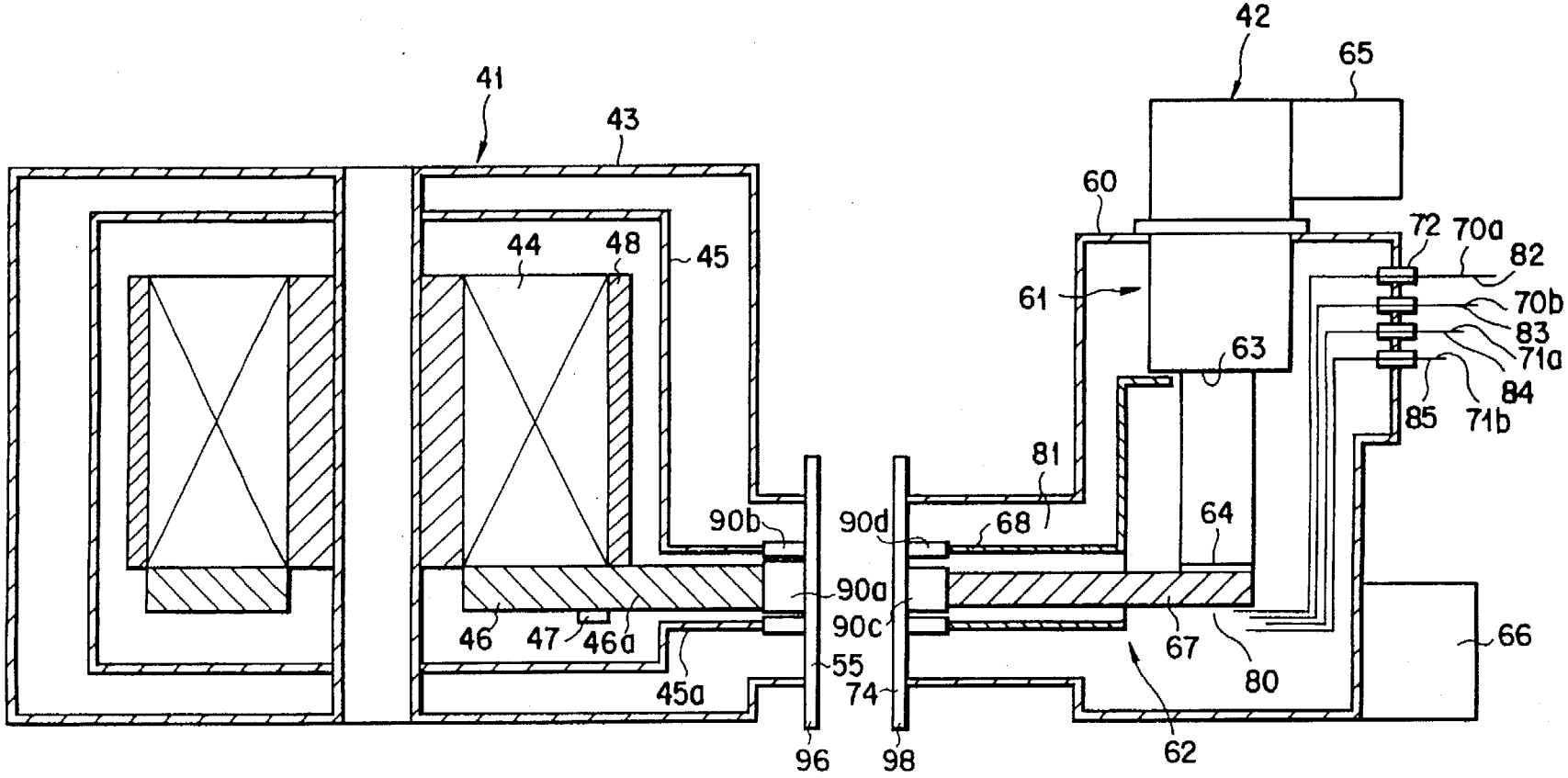
FIG. 8 is a view showing a state in which a coil unit and refrigeration unit are thermally separated.

FIG. 7 shows a state wherein a coil unit 41 and a refrigeration unit 42 are thermally connected, and FIG. 8 shows a state wherein the coil unit 41 and refrigeration unit 42 are thermally separated and the coil unit 41 is thermally insulated.

A heat conductive member 55 formed of a material with good heat conductivity constitutes a part of the wall of a vacuum container 43 accommodating a superconducting coil 44. The heat conductive member 55 has a flange portion 96. A portion 46*a* of a heat conductive member 46 formed of a material with good heat conductivity, which is thermally connected to the superconducting coil 44, is formed so as to extend to the vicinity of the wall of the vacuum container 43. A portion 45*a* of a thermal shield 45, too, is formed so as to extend to the vicinity of the wall of the vacuum container 43.

A gas-type thermal switch 90*a* is provided between the heat conductive member 55 and the portion 46*a* of heat conductive member 46. The thermal switch 90*a* is provided to thermally connect the heat conductive member 55 and the portion 46*a* of heat conductive member 46.

Another gas-type thermal switch 90*b* is provided between the heat conductive member 55 and the portion 45*a* of thermal shield 45. The thermal switch 90*b* is provided to thermally connect the heat conductive member 55 and the portion 45*a* of thermal shield 45.

On the other hand, a heat conductive member 74 formed of a material with good heat conductivity constitutes a part of the wall of a vacuum container 60 accommodating a refrigerator 61. The heat conductive member 74 has a flange portion 97. An end portion of a heat conductive member 67 formed of a material with good heat conductivity, which is thermally connected to a second cooling stage 64, is formed so as to extend to the vicinity of the wall of the vacuum container 60. An end portion of a heat conductive member 68 formed of a material with good heat conductivity, which is thermally connected to a first cooling stage 63 is formed so as to extend to the vicinity of the wall of the vacuum container 60.

In FIGS. 7 and 8, reference numeral 98 denotes bolts for putting the flange portions 96 and 97 into mechanical contact with each other and fastening the same. The fastening of the bolts 98 improves contact between the heat conductive members 55 and 74, enhancing heat conduction with less contact thermal resistance.

A gas-type thermal switch 90*c* is provided between the heat conductive member 74 and end portion of heat conductive member 67. The thermal switch 90*c* is provided to thermally connect the heat conductive member 74 and the end portion of heat conductive member 67.

Another gas-type thermal switch 90*d* is provided between the heat conductive member 74 and an end portion of heat conductive member 68. The thermal switch 90*d* is provided to thermally connect the heat conductive member 74 and the end portion of heat conductive member 68.

Figure 9:
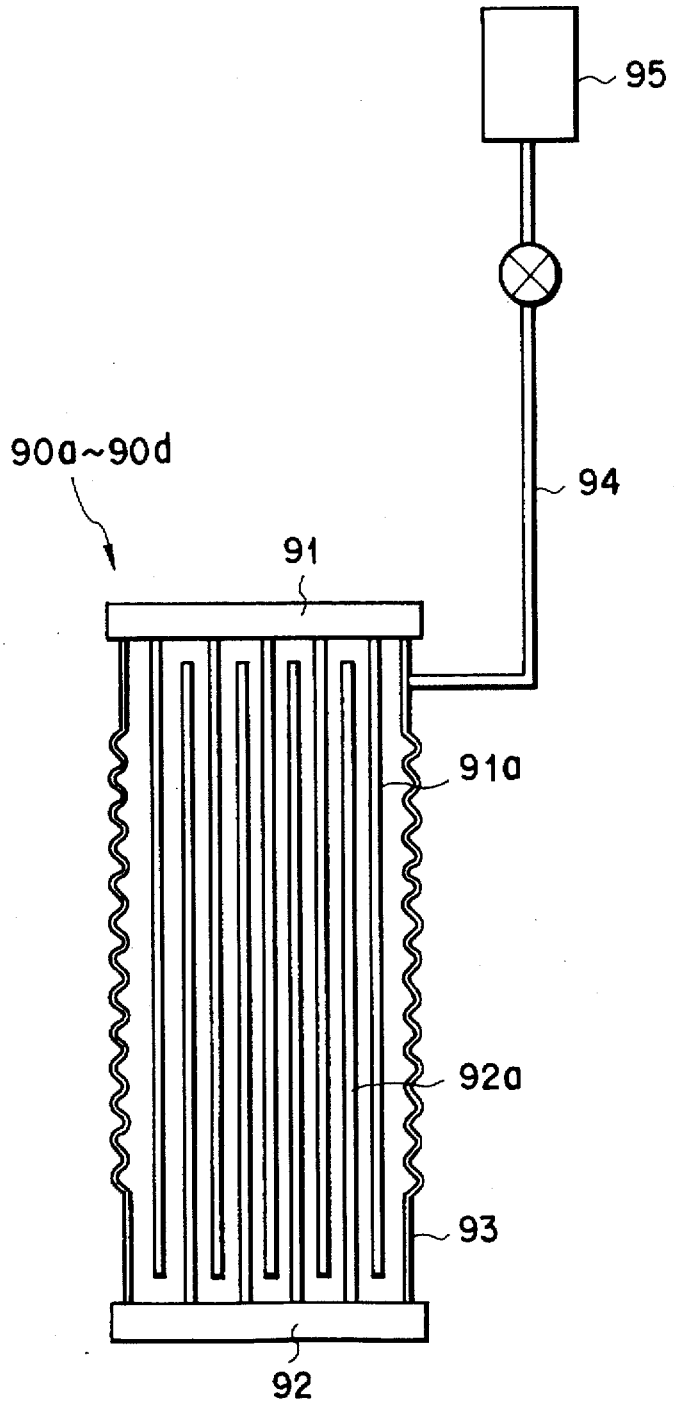
FIG. 9 is a view showing a thermal switch.

These thermal switches 90*a* to 90*d* are gas-type thermal switches for performing thermal connection and disconnection by supplying and exhausting a heat conductive gas into and from the insides of the thermal switches, as shown in FIG. 9.

FIG. 9 shows a detailed structure of each of the thermal switches 90*a* to 90*d*. Specifically, the thermal switches 90*a* to 90*d* are gas-pressure type thermal switches wherein a heat conductive gas supply/exhaust device 95 supplies/exhausts a heat conductive gas such as helium gas via a pipe 94 in/from a cylinder 93 defined at both ends by heat conductive plates 91 and 92, thereby to switch on/off thermal conduction. A number of projection plates 91*a* and 91*b* project from the heat conductive plates 91 and 92 within the cylinder 93, so as to face each other at a small distance in a comb-like arrangement.

When a helium gas is supplied via the pipe 94 from the supply/exhaust device 95 and sealed in the cylinder 93, heat conducts between both heat conductive plates 91 and 92 by virtue of the heat conduction of helium gas. Thus, the thermal switch is turned on. When the helium gas is exhausted and the thermal switch is evacuated, heat conduction between the heat conductive plates 91 and 92 is stopped and the thermal switch is turned off.

The thermal switch, 90*a* to 90*d*, shown in FIG. 9 is a gas-pressure type thermal switch which performs a switching operation by controlling the pressure of the heat conductive gas within the switch. However, the thermal switch, which can be used in the present invention, is not limited to this type.

For example, a mechanical thermal switch may be used. The mechanical thermal switch is provided with a driving mechanism for moving first and second heat conductive members relative to each other. The first and second heat conductive members are mechanically moved and the contact state/non-contact state is switched. When the first and second heat conductive members are put in contact with each other, the mechanical thermal switch effects heat conduction ("switch on"). When the first and second heat conductive members are mechanically separated and set in non-contact state, the mechanical switch renders heat conductive non-effective ("switch off").

A method of putting the coil unit and refrigeration unit into thermal contact in the cooling apparatus having the above structure will now be described.

The refrigerator 61 is driven and then the temperatures of the first and second cooling stages 63 and 64 approach predetermined values. At this time instant, a helium gas is supplied into the thermal switches 90*a* to 90*d* and these switches are turned on.

At least one of the coil unit 41 and refrigerator 42 is moved to put the heat conductive members 55 and 74 in contact with each other. Then, the flanges portions 96 and 97 are fastened by means of bolts 98. Since the heat conductive members 55 and 74 are put in close contact with each other and the thermal resistance is decreased, a good cooling operation can be performed.

The first cooling stage 63 is thermally connected to the thermal shield 45 in the following order of thermal connection: first cooling stage 63→heat conductive member 68→thermal switch 90*d* →heat conductive member 74→heat conductive member 55→thermal switch 90*b* →the portion of thermal shield 45→thermal shield 45.

On the other hand, the second cooling stage 64 is thermally connected to the superconducting coil 44 in the following order of thermal connection: second cooling stage 64→heat conductive member 67→thermal switch 90*c* →heat conductive member 74→heat conductive member 55→thermal switch 90*a* →heat conductive member 46→superconductive coil 46.

When a sufficient time period has passed since the thermal conduction was effected, the temperature of the thermal shield 45 becomes substantially equal to that of the first cooling stage 63 (about 40 K) and the temperature of the superconducting coil 44 becomes substantially equal to that of the second cooling stage 64 (about 4 K). After the thermal shield 45 and superconducting coil 44 have been cooled to target temperatures, the helium gas within the thermal switches 90*a* to 90*d* is exhausted and the thermal switches 90*a* to 90*d* are turned off. In particular, when the thermal switches 90*a* and 90*b* have been turned off, the thermal shield 45 and superconducting coil 44 are completely thermally separated and insulated from the outside of the vacuum container 43.

Subsequently, as shown in FIG. 8, the heat conductive members 55 and 74 are mechanically separated and the coil unit 41 is put out of contact with the refrigerator 42 and thermally insulated from the refrigerator 42. If the heat conductive members 55 and 74 are mechanically separated, they are also thermally separated. The work of mechanically separating the heat conductive members 55 and 74 is equal in operational effect to the work of turning off a mechanical thermal switch which may be provided between the heat conductive members 55 and 74.

Thereafter, in the state in which the superconducting coil 44 is separated from the refrigeration unit 42, the superconducting coil 44 is kept cooled during a cooling time period determined by the heat capacity of the superconducting coil itself and the radiation heat shield effect of the thermal shield 45. The cooling time period can be remarkably increased by increasing the number of thermal shields. For example, the superconducting coil 44 can be cooled for several to several tens of days, or several months.

In the second embodiment, the heat conductive members 55 and 74 are mechanically separable and one of the coil unit 41 and refrigeration unit 42 is movable so that a mechanical thermal switch is theoretically provided between the heat conductive members 55 and 74. However, a gas-type thermal switch may be provided between the heat conductive members 55 and 74.

Inversely, the gas-type thermal switches 90*a* to 90*d* may be replaced with mechanical thermal switches. Besides, the thermal switches 90*c* and 90*d*, provided on the refrigeration unit 42 side, may be dispensed with, if the driving of the refrigerator 61 is started at the time of cooling the coil unit 41 and the driving of the refrigerator 61 is stopped when the coil unit 41 has been completely cooled.

<Third Embodiment>

A cryogenic cooling apparatus according to a third embodiment of the present invention will now be described.

In the first and second embodiments, the superconducting coil is cooled substantially via parts of the walls of vacuum containers.

Figure 10:
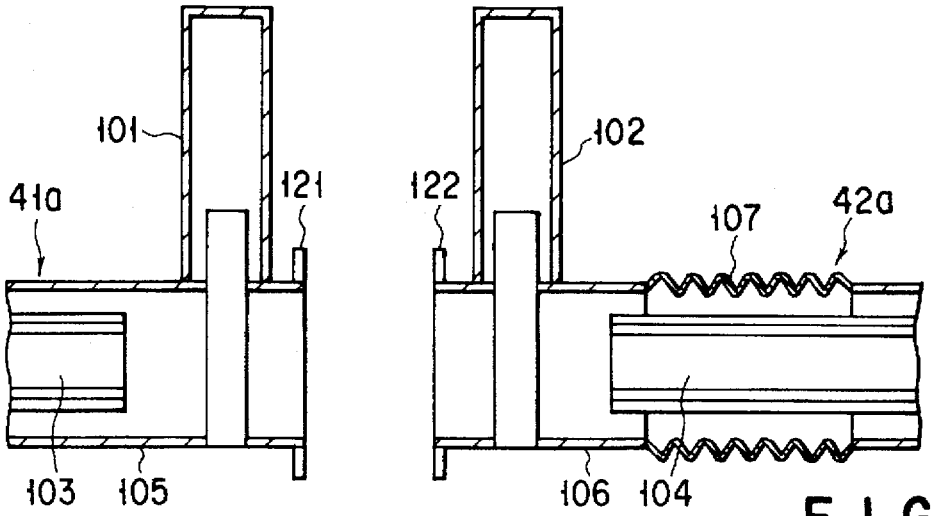
FIG. 10 is a cross-sectional view of a coupling portion between a coil unit and a refrigeration unit of a cryogenic cooling apparatus according to a third embodiment of the invention.

In the second embodiment, as shown in FIG. 10, a coil unit 41*a* and a refrigeration unit 42*a* are provided with vacuum valves 101 and 102. Using the vacuum valves 101 and 102, a heat conductive member 103 of the coil unit 41*a* is put in mechanical contact with a heat conductive member 104 of the refrigeration unit 42*a*, thereby constituting heat conduction paths. The second embodiment is the same as the first embodiment with respect to the other structural features.

A vacuum container 105 of the coil unit 41*a* and a vacuum container 106 of the refrigeration unit 42*a* are provided with flanges 121 and 122.

At least one of the vacuum container 105 of coil unit 41*a* and the vacuum container 106 of refrigeration unit 42*a* is provided with an extendible wall 107 which constitutes a part of the container 105 and/or container 106. In FIG. 10, the container 107 is provided with the extendible wall 107.

Figure 11:
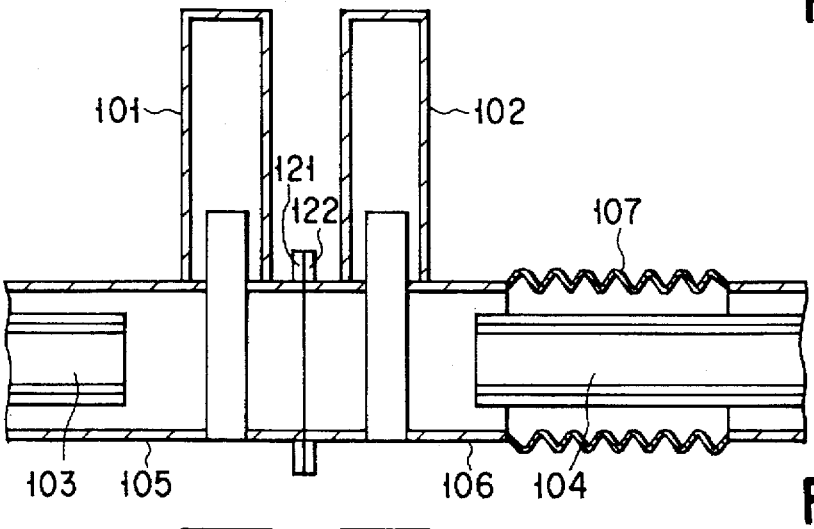
FIG. 11 is a cross-sectional view of the coupling portion between the coil unit and refrigeration unit of the cryogenic cooling apparatus according to the third embodiment.

As is shown in FIG. 11, the coil unit 41*a* and refrigeration unit 42*a* are connected by means of the flanges 121 and 122.

Figure 12:
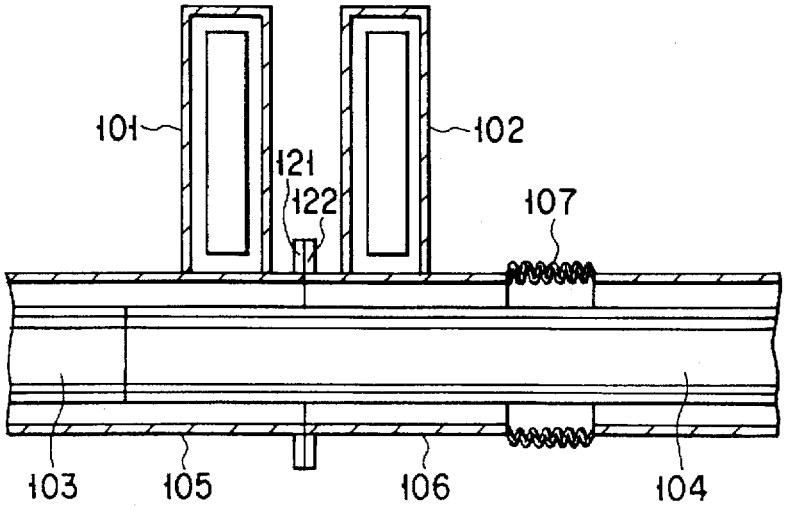
FIG. 12 is a cross-sectional view of the coupling portion between the coil unit and refrigeration unit of the cryogenic cooling apparatus according to the third embodiment.

Then, as shown in FIG. 12, the vacuum valves 101 and 102 are released and in this state the coil unit 41*a* and refrigeration unit 42*a* are moved to approach each other. In accordance with the movement, the extendible wall 107 contracts and the heat conductive member 103 of coil unit 41*a* and the heat conductive member 104 of refrigeration unit 42*a* come into mechanical contact with each other, thereby constituting a heat conduction path.

The coil unit 41*a* and refrigeration unit 42*a* can be separated by the reverse procedure.

With the above structure, the superconducting coil can be cooled while the vacuum in the coil unit 41*a* and refrigeration unit 42*a* is maintained.

In this embodiment, too, when the mechanical-contact type heat conduction path extending from the refrigeration unit 42*a* to coil unit 41*a* is formed, it is desirable to provide conductors which are electrically connected to constitute power leads of the superconducting coil and control wires of the permanent current switch.

In the present embodiment, the heat conductive member 103 of coil unit 41*a* and the heat conductive member 104 of refrigeration unit 42*a* are put in direct contact with each other. The contact faces of the heat conductive members 103 and 104 may be plated with gold or mirror-finished.

Figure 13:
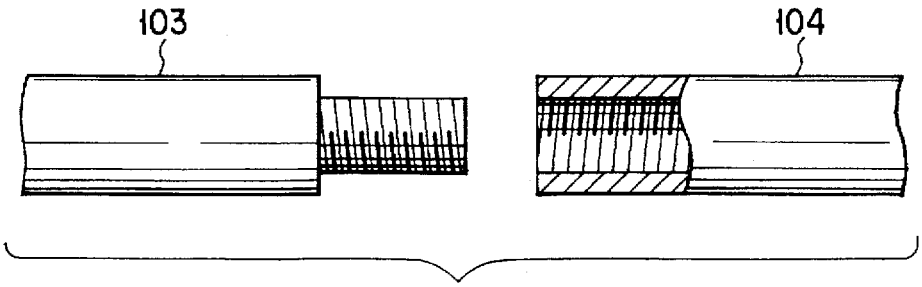
FIG. 13 is an enlarged view of a coupling portion between a heat conductive member of the coil unit of the cryogenic cooling apparatus according to the third embodiment and a heat conductive member of the refrigeration unit.

Besides, as is shown in FIG. 13, a distal end portion of the heat conductive member 103 may be formed in the shape of a male screw, and a distal end portion of the heat conductive member 104 may be formed in the shape of a female screw, so that the heat conductive member 103 may be engaged in the heat conductive member 104.

Thereby, the contact area between the heat conductive members 103 and 104 increases and, as a result, the efficiency of heat conduction between the heat conductive members 103 and 104 is enhanced.

<Fourth Embodiment>

Figure 14:
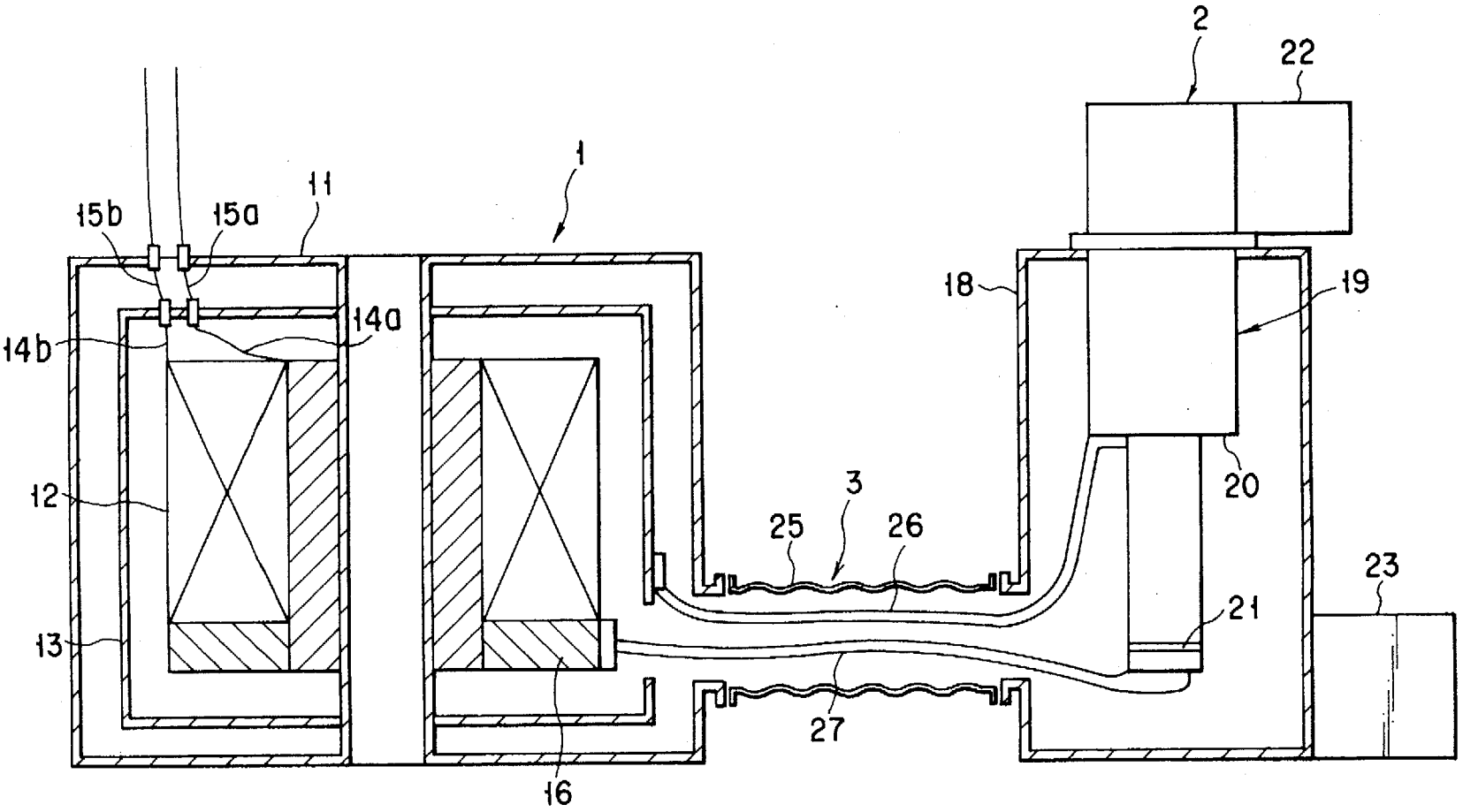
FIG. 14 is a cross-sectional view of a part of a cryogenic cooling apparatus according to a fourth embodiment of the invention.

FIG. 14 is a cross-sectional view of a part of a cryogenic cooling apparatus according to a fourth embodiment of the invention.

This cryogenic cooling apparatus generally comprises a coil unit 1, a refrigeration unit 2 and a connector unit 3 for connecting the coil unit 1 and refrigeration unit 2.

The coil unit 1 comprises an annular vacuum container 11 functioning as a heat insulating container formed of a nonmagnetic material such as stainless steel, a superconducting coil 12 housed within the vacuum container 11, and a thermal shield 13 disposed between the superconducting coil 12 and vacuum container 11 so as to surround the superconducting coil 12.

The superconducting coil 44 is formed of an Nb—Ti alloy wire or an $Nb_3Sn$ wire and is supported by heat insulating support means (not shown). End portions of the superconducting coil 12 are connected to first end portions of oxide superconducting wires 14*a* and 14*b* constituting parts of power leads. Second end portions of the oxide superconducting wires 14*a* and 14*b* are connected to first end portions of copper leads 15*a* and 15*b*.

Connecting portions between the oxide superconducting wires 14*a* and 14*b* and copper leads 15*a* and 15*b* are thermally connected to the thermal shield 13 by means of insulators such as aluminum nitride.

Second end portions of the copper leads 15*a* and 15*b* are led to the outside via bushings provided to hermetically penetrate an upper wall of the vacuum container 11. In addition, a heat conductive member 16 formed of a material with good heat conductivity, e.g. copper, aluminum or aluminum nitride, is thermally connected to a lower end face (in FIG. 14) of the superconducting coil 12.

The refrigeration unit 2 comprises a vacuum container 18 and a cold accumulating refrigerator 19 situated to extend inside and outside the vacuum container 18 such that cooling stages are located within the vacuum container 18.

In this embodiment, the cold accumulating refrigerator 19 is constituted by a two-stage expansion type Gifford-MacMahon refrigerator. In the cold accumulating refrigerator 19, copper mesh, etc. is used as a cold accumulation element in a first-stage cold accumulator, and a magnetic cold accumulation element such as $Er_3Ni$, which makes use of abnormal magnetic specific heat due to magnetic phase transition, is used as a cold accumulation element in a second-stage cold accumulator.

By the use of these cold accumulating elements, cold of about 50 K is generated by a first-stage cooling stage 20 and cold of about 4 K is generated by a second-stage cooling stage 21. In FIG. 14, reference numeral 22 denotes a motor for reciprocally moving the cold accumulators connected serially in two stages, and numeral 23 denotes a compressor for compressing and sucking a coolant gas.

On the other hand, the connector unit 3 comprises a flexible pipe 25, a heat conductive member 26 and another heat conductive member 27. The flexible pipe 25 communicates hermetically with the inside of the vacuum container 11 of coil unit 1 and the inside of the vacuum container 18 of refrigeration unit 2. The heat conductive member 26 has one end thermally connected to the first cooling stage 20 of cold accumulating refrigerator 19 and the other end thermally connected to the thermal shield 13 through the pipe 25. The other heat conductive member 27 has one end thermally connected to the second cooling stage 21 of cold accumulating refrigerator 19, and the other end thermally connected to the heat conductive member 16 through the pipe 25.

Figure 15:
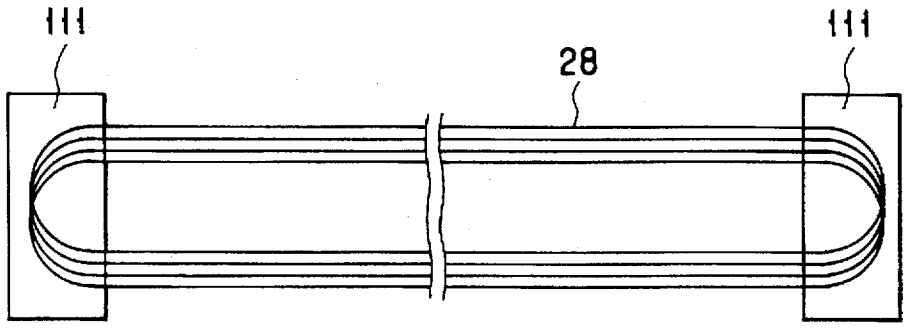
FIG. 15 shows the structure of a loop-type thin heat pipe built in as a part of a heat conductive member.

Each of the heat conductive members 26 and 27 is constituted by a high-heat-conductivity member including, at least partly, a flexible portion, or a loop-type thin heat pipe 28 shown in FIG. 15, or a combination of the high-heat-conductivity member including, at least partly, a flexible portion and the loop-type thin heat pipe 28.

Figure 16:
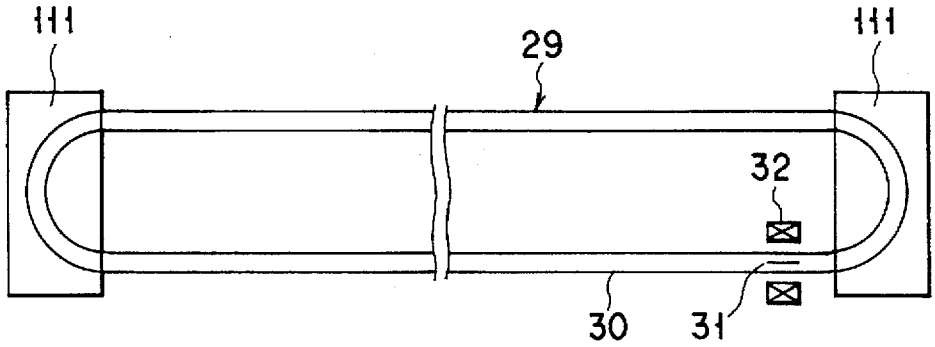
FIG. 16 shows the structure of a dream pipe capable of being built in as a part of a heat conductive member.

Each of the heat conductive members 26 and 27 may be a dream pipe 29 as shown in FIG. 16, or a combination of the high-heat-conductivity member including, at least partly, a flexible portion and the dream pipe 29.

The dream pipe 29 utilizes shuttle heat transmission occurring through the wall of the pipe when a medium sealed in the closed-loop pipe is reciprocally moved. For example, a magnetic piece 31 is disposed within the pipe 30, and the magnetic piece 31 is reciprocally moved by means of a coil 32 provided outside the pipe.

Both end portions of the loop-type thin heat pipe 28 or dream pipe 29 are attached to the cooling stage of the refrigerator, etc. by means of a heat conductive element formed of, e.g. copper.

In the above structure, when the operation of the cold accumulating refrigerator 19 is started, the heat of the superconducting coil 12 is absorbed by the second cooling stage 21 of cold accumulating refrigerator 19 via the heat conductive members 16 and 27, and the heat of the thermal shield 13 is absorbed by the first cooling stage 20 via the heat conductive member 26.

If a predetermined time period has passed, the superconducting coil 12 is cooled to about 4 K which is below a critical temperature, and the thermal shield 13 is cooled to about 50 K.

In this state, if a current of a predetermined level is supplied to the superconducting coil 12 via the copper leads 15*a* and 15*b* and oxide superconducting wires 14*a* and 14*b*, a desired magnetic field can be generated.

In this case, a sufficient distance can be kept between the vacuum container 11 housing the superconducting coil 12 and the vacuum container 18 for the refrigerator. Accordingly, the size of the coil unit 1 can be reduced independently of the presence of the refrigerator.

Since the sufficient distance can be kept, as mentioned above, magnetic interference between the magnetic field generated by the superconducting coil 12 and the magnetic cold accumulation element can be prevented even if the cold accumulating refrigerator 19 wherein the magnetic cold accumulation element is built in the accumulator is used, as in the present embodiment.

Accordingly, the symmetry of magnetic field generated by the superconducting coil 12 is not lost, and the cold accumulator is prevented from being inclined. Therefore, the refrigeration performance of the refrigerator can be stably maintained over a long time period.

Since the coil unit 1 and refrigeration unit 2 are connected by means of the flexible pipe and heat conductive members 26 and 27, the vibration of the cold accumulating refrigerator 19 is prevented from being transmitted to the superconducting coil 12 and the uniformity of the magnetic field can be maintained.

Although Nb—Ti alloy wires and $Nb_3Sn$ wires have been mentioned as examples of the material of the superconducting coil 12, 44, oxides (high temperature) of La, Y, Bi, Tl, Pb and Hg may be used.

The cryogenic cooling apparatus of the present invention is applicable to MRIs, NMRs linear motor-cars, single-crystal drawing apparatuses, etc.

As has been described above, according to the present invention, the degree of freedom of installation and use of the cooling apparatus can be increased without deteriorating the reliability and stability, and the range of uses can be greatly increased.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

We claim:

1. A cooling apparatus for cooling an object, said apparatus comprising:

a first vacuum container;

a cooling source housed within the first vacuum container;

a second vacuum container, provided separately from the first vacuum container, for accommodating the object; and thermal connection and disconnection means for thermally connecting the cooling source and the object when the object is to be cooled by the cooling source, and thermally disconnecting the cooling source and the object when the object is to be thermally insulated.

2. The cooling apparatus according to claim 1, wherein the thermal connection and disconnection means thermally connects and disconnects the cooling source and the object in the state in which the insides of the first and second vacuum containers are set in a vacuum state.

3. The cooling apparatus according to claim 1, wherein said thermal connection and disconnection means comprises a first heat conductive member with heat conductivity, which forms a part of the first vacuum container, and a second heat conductive member with heat conductivity, which forms a part of the second vacuum container, and wherein the cooling source and the object are thermally connected via the first and second heat conductive members with, so that the cooling source and the object can be thermally connected and disconnected in the state in which the insides of the first and second vacuum containers are set in a vacuum state.

4. The cooling apparatus according to claim 1, wherein said thermal connection and disconnection means includes at least one thermal switch means, and wherein when the object is to be cooled by the cooling source, the thermal switch means is turned on to thermally connect the cooling source and the object, and when the object is to be thermally insulated, the thermal switch means is turned off to thermally disconnect the cooling source and the object.

5. The cooling apparatus according to claim 1, wherein said thermal connection and disconnection means includes:

a first heat conductive member with heat conductivity, which forms a part of the first vacuum container;

a second heat conductive member with heat conductivity, which forms a part of the second vacuum container;

a first thermal switch means provided between the object and the first heat conductive member with heat conductivity; and a second thermal switch means provided between the first and second heat conductive members with heat conductivity.

6. The cooling apparatus according to claim 5, wherein said second thermal switch conducts heat by holding the first and second heat conductive members with heat conductivity in contact with each other, and stops heat conduction by holding the first and second heat conductive members with heat conductivity out of contact with each other when said the first and second vacuum containers are moved relative to each other.

7. The cooling apparatus according to claim 1, wherein said thermal connection and disconnection means includes:

a first heat conductive member thermally connected to the cooling source;

a second heat conductive member thermally connected to the object;

a third heat conductive member provided on a part of a wall of the first vacuum container; and a fourth heat conductive member provided on a part of a wall of the second vacuum container, whereby the object is cooled by putting the first to fourth heat conductive members in thermal contact with each other, and the object is thermally insulated by thermally disconnecting the second and fourth heat conductive members.

8. The cooling apparatus according to claim 1, wherein said thermal connection and disconnection means includes:

a first heat conductive member thermally connected to the cooling source;

a second heat conductive member thermally connected to the object;

a third heat conductive member provided on a part of a wall of the first vacuum container;

a fourth heat conductive member provided on a part of a wall of the second vacuum container; and thermal switch means for thermally connecting and disconnecting the second and fourth heat conductive members, whereby the thermal switch means is turned on to thermally connect the first to fourth heat conductive members to each other, thereby to cool the object, and to thermally disconnect the second and fourth heat conductive members, thereby to thermally insulate the object.

9. The cooling apparatus according to claim 1, wherein said thermal connection and disconnection means includes:

a first heat conductive member thermally connected to the cooling source;

a second heat conductive member thermally connected to the object;

a third heat conductive member provided on a part of a wall of the first vacuum container;

a fourth heat conductive member provided on a part of a wall of the second vacuum container;

first thermal switch means for thermally connecting and disconnecting the second and fourth heat conductive members; and second thermal switch means for thermally connecting and disconnecting the third and fourth heat conductive members.

10. The cooling apparatus according to claim 1, wherein said thermal connection and disconnection means includes:

a first heat conductive member thermally connected to the cooling source;

a second heat conductive member thermally connected to the object;

a first extendible wall provided on a part of the first vacuum container;

a second extendible wall provided on a part of the second vacuum container;

a third heat conductive member, disposed on the first extendible wall, for conducting heat of the first heat conductive member when the third heat conductive member is put in contact with the first heat conductive member; and a fourth heat conductive member, disposed on the second extendible wall, for conducting heat from the third heat conductive member to the second heat conductive member when the fourth heat conductive member is put in contact with the second heat conductive member and the third heat conductive member.

11. The cooling apparatus according to claim 1, wherein said thermal connection and disconnection means includes:

a first heat conductive member thermally connected to the cooling source;

a second heat conductive member thermally connected to the object;

a first vacuum valve for maintaining a vacuum in the first vacuum container; and a second vacuum valve for maintaining a vacuum in the second vacuum container, wherein the first vacuum valve and second vacuum valve are opened such that the first vacuum container and second vacuum container communicate with each other while maintaining the vacuum state in the first vacuum container and second vacuum container, and the first heat conductive member and second heat conductive member are thermally connected.

12. The cooling apparatus according to claim 1, wherein said cooling source is a refrigerator having a cooling stage.

13. The cooling apparatus according to claim 1, wherein said cooling source is a coolant contained in said first vacuum container.

14. The cooling apparatus according to claim 1, wherein said object is a superconducting coil.

15. The cooling apparatus according to claim 14, further comprising current leads for supplying a current to the superconducting coil.

16. The cooling apparatus according to claim 15, wherein said current leads are provided on the thermal connection and disconnection means, and the current leads are electrically connected in the state in which the thermal connection and disconnection means is set in a thermal connection state.

17. The cooling apparatus according to claim 3, wherein said object is a superconducting coil, and said first heat conductive member with heat conductivity, which constitutes the part of the first vacuum container, and said second heat conductive member with heat conductivity, which constitutes the part of the second vacuum container, are provided with electrical conductive portions with electrical conductivity for supplying a current to the superconducting coil.

18. The cooling apparatus according to claim 1, further comprising a cold accumulation layer put in thermal contact with the object.

19. The cooling apparatus according to claim 18, wherein said cold accumulation layer includes a cold accumulation element having a high specific heat at temperatures near a cooling temperature of the object.

20. The cooling apparatus according to claim 18, wherein said cold accumulation layer includes a container filled with at least one coolant selected from among the group consisting of helium, hydrogen, neon, nitrogen and argon.

21. The cooling apparatus according to claim 1, further comprising a thermal shield provided within the second vacuum container so as to surround the object.

22. The cooling apparatus according to claim 21, wherein the cooling source is a refrigerator having first and second cooling stages with different target temperatures, the first cooling stage with the higher target temperature cooling the thermal shield, the second cooling with the lower target temperature cooling the object.

23. The cooling apparatus according to claim 22, wherein said thermal connection and disconnection means includes:

a first heat conductive member thermally connected to the second cooling stage;

a second heat conductive member thermally connected to the object;

a third heat conductive member provided on a part of a wall of the first vacuum container;

a fourth heat conductive member provided on a part of a wall of the second vacuum container;

a fifth heat conductive member thermally connected to the first cooling stage; and a sixth heat conductive member thermally connected to the thermal shield, whereby the first, second, third and fourth heat conductive members are thermally connected to cool the object, the third, fourth, fifth and sixth heat conductive members are thermally connected to cool the object, and the second and fourth heat conductive members are thermally disconnected to thermally insulate the object.

24. A cooling apparatus for cooling an object, said apparatus comprising:

a first vacuum container;

a refrigerator contained in the first vacuum container and having a cooling stage;

a second vacuum container, provided separately from the first vacuum container, for accommodating the object;

a first heat conductive member with heat conductivity, which constitutes a part of the first vacuum container; and a second heat conductive member with heat conductivity, which constitutes a part of the second vacuum container, wherein when the object is to be cooled by the cooling stage, the cooling stage and the first heat conductive member with heat conductivity are thermally connected, the second heat conductive member with heat conductivity and the object are thermally connected, and the first and second heat conductivity members with heat conductivity are thermally connected, thereby thermally connecting the cooling stage and the object, and when the object is thermally insulated, the object and the second heat conductive member with heat conductivity are thermally disconnected, and the first and second heat conductive members with heat conductivity are thermally disconnected, thereby thermally insulating the object from the outside of the second vacuum container.

25. The cooling apparatus according to claim 24, wherein said object is a superconducting coil, and said first heat conductive member with heat conductivity, which constitutes the part of the first vacuum container, and said second heat conductive member with heat conductivity, which constitutes the part of the second vacuum container, are provided with electrical conductive portions with good electrical conductivity for supplying a current to the superconducting coil.

26. A cooling apparatus for cooling an object, said apparatus comprising:

a first container;

a cooling source housed within the first container;

a second container formed to be capable of accommodating the object;

a pipe including, at least as a portion thereof, a flexible portion, for connecting the first and second vacuum containers in the state in which the insides of the first and second containers are set in a vacuum state; and a heat conductive member for thermally connecting the cooling source and the object through the pipe.

27. The cooling apparatus according to claim 26, wherein at least a portion of the heat conductive member is flexible.

28. The cooling apparatus according to claim 26, wherein at least a portion of the heat conductive member is formed of a loop-shaped thin heat pipe.

29. The cooling apparatus according to claim 26, wherein at least a portion of the heat conductive member is formed of a dream pipe.

30. The cooling apparatus according to claim 26, wherein the object is a superconducting coil and the cooling source is a refrigerator having a cooling stage.

31. The cooling apparatus according to claim 26, further comprising:

a thermal shield provided within the second vacuum container so as to surround the object; and a second heat conductive member for thermally connecting the cooling source and the thermal shield through the pipe.

32. A cooling method for a cooling apparatus comprising:

a first vacuum container;

a cooling source housed within the first vacuum container; and a second vacuum container, provided separately from the first vacuum container, for accommodating the object, said method comprising the steps of:

thermally connecting the cooling source and the object to cool the object by means of the cooling source; and thermally disconnecting the cooling source and the object to thermally insulate the object.

33. A cooling method for a cooling apparatus comprising:

a first vacuum container;

a cooling source contained in the first vacuum container and having a cooling stage;

a second vacuum container, provided separately from the first vacuum container, for accommodating the object;

a first heat conductive member with heat conductivity, which constitutes a part of the first vacuum container; and a second heat conductive member with heat conductivity, which constitutes a part of the second vacuum container, said method comprising the steps of:

thermally connecting the cooling source and the first heat conductive member with heat conductivity;

thermally connecting the second heat conductive member with heat conductivity and the object;

thermally connecting the first and second heat conductivity members with heat conductivity, thereby cooling the object by means of the cooling source;

thermally disconnecting the object and the second heat conductive member with heat conductivity; and thermally disconnecting the first and second heat conductive members with heat conductivity, thereby thermally insulating the object.

* * * * *